United States Patent [19]

Walter

[11] Patent Number: 4,499,355

[45] Date of Patent: Feb. 12, 1985

[54] HEATED PERSONAL CARE APPLIANCES

[75] Inventor: Henry J. Walter, Dunedin, Fla.

[73] Assignee: Clairol Incorporated, New York, N.Y.

[21] Appl. No.: 589,857

[22] Filed: Mar. 16, 1984

Related U.S. Application Data

[63] Continuation of Ser. No. 429,574, Sep. 30, 1982, abandoned, which is a continuation of Ser. No. 247,466, Mar. 25, 1981, abandoned.

[51] Int. Cl.[3] ..... H05B 6/10

[52] U.S. Cl. ..... 219/10.49 R; 219/10.57; 219/10.77; 219/222

[58] Field of Search ..... 219/10.49 R, 10.57, 219/10.67, 10.79, 10.75, 10.77, 222, 242, 390, 228, 521; 335/208, 146, 302

[56] References Cited

U.S. PATENT DOCUMENTS

| | | | |
|---|---|---|---|
| 491,313 | 2/1893 | Jenkins | 219/222 X |
| 2,181,274 | 11/1939 | Jackson et al. | 219/10.49 R X |
| 2,561,609 | 7/1951 | Briggs | 219/10.49 R |
| 3,206,573 | 9/1965 | Anderson et al. | 335/146 X |
| 3,665,939 | 5/1972 | Laing | 219/222 X |
| 3,696,819 | 10/1972 | Jensen | 219/222 X |
| 3,973,100 | 8/1976 | Flanagan | 219/242 X |
| 4,004,596 | 1/1977 | Hyland | 219/222 X |
| 4,109,667 | 8/1978 | Quirk | 219/242 X |

*Primary Examiner*—Philip H. Leung

*Attorney, Agent, or Firm*—Gene Warzecha; Stuart E. Krieger

[57] ABSTRACT

There is disclosed induction heated personal care appliances such as hair rollers, curling irons and massagers. The appliance is generally cylindrical and made of plastic. It has either a high permeability cylinder attached tightly on its inner surface, or has the high permeability material as a particulate filler in the plastic. The induction heater is a non-conducting plastic cylindrical well with from 20 to 60 turns of an insulated wire coiled around its outer perimeter. The coil is powered by an oscillator and produces about 1 to 100 kHz.

1 Claim, 6 Drawing Figures

HEATED PERSONAL CARE APPLIANCES

This application is a continuation of application Ser. No. 429,574, filed Sept. 30, 1982, now abandoned, which was itself a continuation of parent application Ser. No. 247,466, filed Mar. 25, 1981, now abandoned.

DESCRIPTION

Background of the Invention

The present invention pertains to heated personal care appliances such as hair rollers, curling irons, massager attachments, body brush attachments, and the like. More particularly, this invention relates to personal care appliances which are heated by induction.

Personal care appliances presently are heated by conduction. Conduction heating requires the transfer medium to have sensible heat and could involve safety problems for the user. In addition, the time required to heat a personal care appliance to a desired temperature by conduction is generally about 10 to 15 minutes. Optimally, it is desired to have a shorter heat-up time, particularly in the case of hairsetters and curlers.

The methods of controlling the temperature of a conduction heated appliance are thermostatic, self-regulating, and might have indicators which notify the user that the operating temperature has been reached.

Accordingly, means to heat in a very short time, control the temperature, and avoid safety hazards are desiderata of a satisfactory appliance.

The use of induction heating when styling hair has been previously attempted, with indifferent success. For example, Schmidt, U.S. Pat. No. 2,526,283, issued Oct. 17, 1950, discloses winding hair tresses moistened with permanent waving fluid onto a metal pin, placing a metal clamp around the moist hair, and connecting the pin and the clamp to a high frequency transformer to thereby conduct high frequency energy through the moistened hair. This type of device causes safety and temperature control problems.

Briggs, U.S. Pat. No. 2,561,609, issued July 24, 1951, discloses winding the hair onto a metallic roller, covering the hair with a low permeability metal split sleeve and then heating the arrangement on the head of the user with an induction coil.

Boudouris, et al, U.S. Pat. Nos. 3,760,148, issued Sept. 18, 1973, and 3,863,653, issued Feb. 14, 1975, disclose treating permanent waving solution saturated hair with an electromagnetic field to raise the temperature of the hair. The hair is placed in a closed cylindrical inner and outer jacket. The inner jacket (roller) carries a coil which in combination with the outer jacket creates a resonant circuit to produce a high frequency field which heats the hair through dielectric losses.

The above prior art systems heat the hair on the users head and have not satisfactorily solved the safety and temperature control problems. Also, they are inconvenient to use and are not applicable to a broad spectrum of personal care appliances as contemplated by the present invention.

SUMMARY OF THE INVENTION

Accordingly, it is an object of this invention to provide a heating system for personal care appliances which appliances contain a high permeability material to make them amenable to heating by induction.

A further object of this invention is to provide personal care appliances containing a high permeability material to make them amenable to heating by induction.

Another object of this invention is to provide a method of heating personal care applicances by induction, and apparatus comprising a hollow cylinder surrounded by a coil to accomplish the induction heating.

Still another object of this invention is to provide a means to control the temperature to which the appliance is heated, either by magnetic means using a Curie metal cup and a magnet attached to a switch, a Hall detector, independent control timers or feed-back systems.

Yet another object of this invention is to provide a method and apparatus comprising plastic rollers with a metallic cylinder therein, a well with a coil, and an electric power source for providing proper frequency to heat hair rollers by induction.

Some advantages of the present invention are that the personal care applicances, e.g. hair rollers, curling irons and the like, are heated in less than 60 seconds, an unlimited number of units can be heated consecutively, various sizes and types of appliances can be heated, no parts which are handled become excessively hot, no electrical contacts are exposed and temperatures are closely controlled. In addition, the structure of the heating unit is simple, economic and easy to manufacture.

The apparatus of this invention is comprised of three essential components, (a) the appliance which is heated; (b) the induction heater; and (c) the electrical circuit.

The appliance which is heated can be any of, for example, hair rollers, curling irons, massager attachments, body brush attachments and the like. The appliance is preferably circular in shape and is made of electric non-conductive material such as plastic which has a material of high permeability to electricity either as part of its structure, or as a filler. For example, a cylindrical hair roller could be a plastic body lined with the high permeability material, whereas, a massage attachment could be a plastic body having the high permeability material as a particulate filler throughout. A curling iron could be a high permeability material which could be coated with a plastic. A preferred high permeability material is low carbon steel. Other materials such as nickel, cobalt and aluminum can be used, but are less preferred because they either are too costly or inefficient when compared to steel. Preferred, plastics used for the appliance are, nylons, polycarbonates, polyolefins, polyesters, polypropylenes, polyethylenes and the like as well as thermosetting plastics.

The induction heater of this invention comprises a hollow cylinder having a predetermined number of turns of an insulated wire wrapped around it. The cylinder can be open at both ends, but for most uses, e.g., heating hair rollers and curling irons, it is closed at one end to form a well. The cylinder is made of a material, preferably plastic, which is a non-conductor of electricity. The insulated wire which is wrapped around the cylinder is connected to an oscillator circuit which operates on alternating current, usually 110–120 V or 220 V, and provides a frequency of from about 1 to 100 kHz.

The circuit which powers the induction coil can be any number of types. Thus, a suitable circuit is a modified Hartley oscillator circuit which contains at least one transistor as the control device.

A preferred method of controlling the temperature of the appliance is to use a magnetic self-limiting system.

This is accomplished by adding a low Curie point alloy insert to the portion of the appliance which is inserted into the bottom of the well. When the appliance is placed into the well, a biased magnet properly placed is attracted to the Curie alloy causing a lever to activate a switch which completes the circuit allowing the current to flow to the oscillator circuit and subsequently to the coil, causing the appliance with the alloy whose Curie point is at the desired temperature to heat up in the well to the same temperature as the high permeability component. When the Curie point of the alloy is reached, the alloy loses its magnetic properties. The magnet then is no longer attracted to the alloy and moves away, turning the switch off. The heated appliance can then be removed and used.

In a preferred embodiment, the heat conduction between the plastic body of a hair roller and the high permeability sleeve is controlled to create a time delay, so that the outside surface of the roller is at a low temperature at the conclusion of the heating cycle to facilitate handling, and reaches its final temperature after placement into the hair.

DETAILED DESCRIPTION OF THE INVENTION

Figure 1:
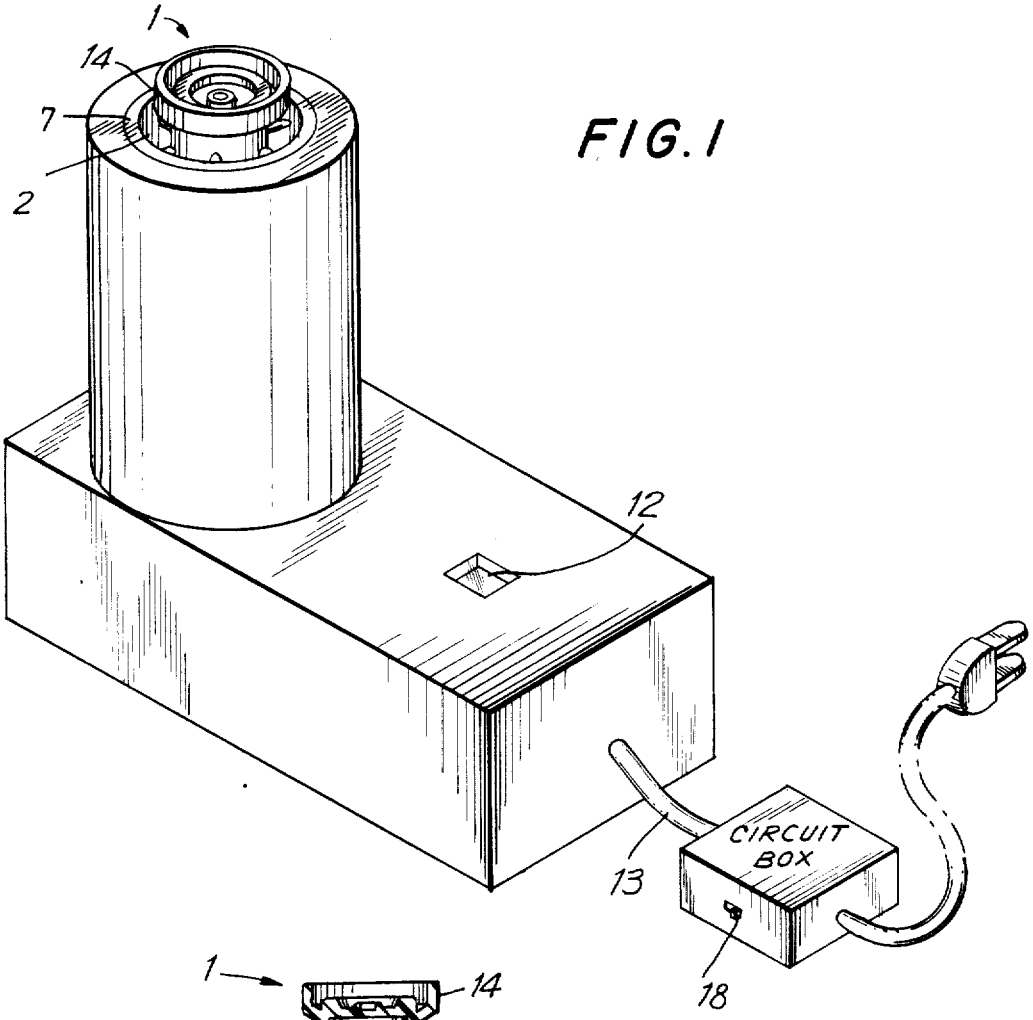
FIG. 1 is a perspective view of a heating unit having a hair roller therein.
Figure 2:
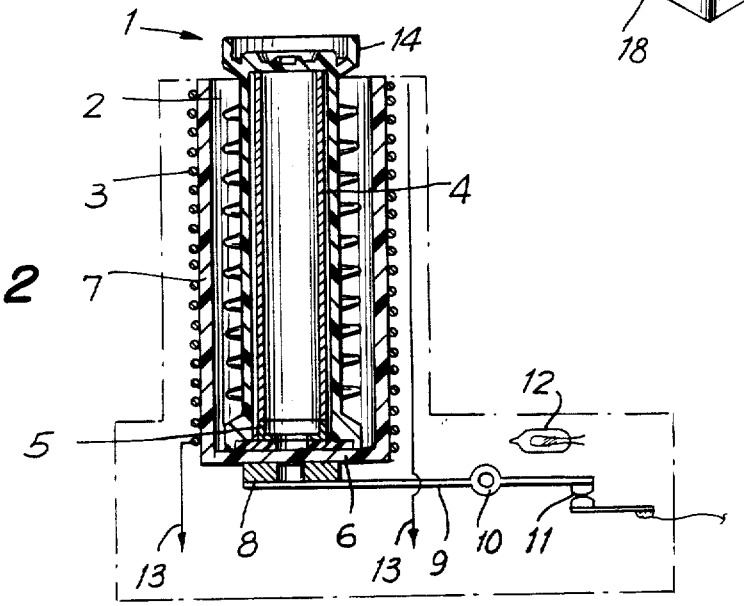
FIG. 2 is a sectional side elevation of a heating unit having a heatable hair roller therein.
Figure 3:
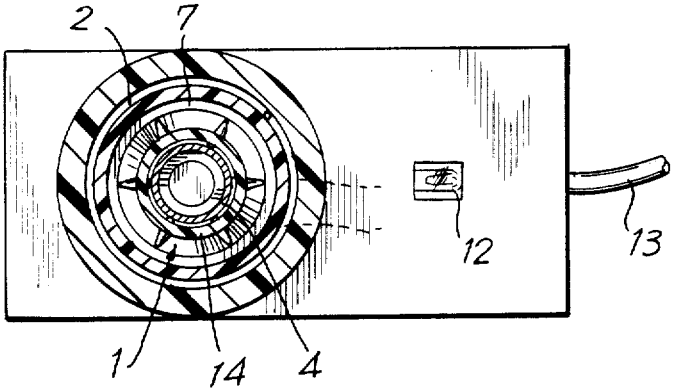
FIG. 3 is a top sectional view of a heating unit with a hair roller therein.

The appliance to be heated is comprised of a plastic non-conductor of electricity having a material of high permeability to electricity either as part of its structure, or as a filler. Iron, nickel, cobalt and aluminum are examples of high permeability materials. Best results are obtained with a carbon steel cylinder heated by a frequency of between 1 and 100 kHz.

In the case of curling irons or hair rollers, the metal cylinder can be a liner on the inner surface. In the case of, for example, massage heads, the high permeability material is preferably a filler in the plastic part of the massage head.

It is also possible for curlers to have the high permeability material as a filler in the cylindrical plastic portion rather than have a metal cylinder liner. However, the metal cylinder liner is more efficient and is preferred.

The preferred embodiment of this invention, i.e., a hair roller, is heated in an induction coil which is also the tank coil of the oscillator circuit. Coils with from about 20–60 turns are suitable, however, it is preferred to have a 40–60 turn coil with 40 turns most preferred. The circuit with the 40 turn coil develops about 260–270 watts in the curler while drawing about 360–370 watts from the line, causing the roller to heat to about 110° C. in about 8–15 seconds.

In determining the various parameters to be considered when choosing the frequency and the number of turns needed in the induction coil surrounding the cylinder which forms the receptacle into which the appliance is inserted, the ratio of the diameter of the load, e.g., hair roller, to the "skin depth" (defined below) of the induced current in the load needs to be considered. For best efficiency the ratio should be at least 4.5.

If the cylinder diameter is about 4.5 times "skin depth", highest efficiency of energy transfer from induction coil to the load will occur and larger diameters will not cause additional efficiency increases. If smaller than this value, efficiency of energy transfer decreases as the diameter gets smaller.

The frequency of the induction power source needs to be established first since it is usually the controlling parameter. The frequency is determined by the configuration of the load. Optimum configuration is a cylinder, such as a hair roller.

A cylinder surrounded by a solenoid coil carrying alternating current has a current induced in it. The induced current decreases in magnitude toward the center of the cylinder. The most efficient heating occurs if the cylinder is large with respect to the "skin depth". The "skin depth" is defined in centimeters as:

$$d = 5(10^3)\sqrt{\frac{\rho}{\mu f}}$$

d = skin depth in centimeters
$\rho$ = resistivity of cylinder in ohm-cm
$\mu$ = relative magnetic permeability
f = frequency in Hertz The efficiency of a thin walled cylinder is also dependent on the skin depth, but the wall thickness as well as the diameter are involved in a complex relationship. There is nevertheless a minimum frequency below which a hair roller, for example, cannot be efficiently heated. This point is below 1 kilohertz. The range at which a hair roller can be efficiently heated is between about 1 to about 100 kilohertz.

The configuration and structure of the induction coil in an induction heating system affects both efficiency and heating pattern. The factors involved in determining the efficiency of power transfer are closeness of coil coupling, length to diameter ratio, induction coil material and coil turns spacing. The efficiency of power transfer is also dependent upon the ratio of the conductivities of the induction coil and the load. The load should have a conductivity much smaller than the coil.

The power source is also important. It has been found that a power level of about 350–500 watts for 10 seconds is needed in hair curlers to achieve the desired power output of 250–300 watts from the oscillator circuit. A coil of about 40 to 60 turns at a frequency of about 1 to 100 kilohertz has been found satisfactory; with 40 turns most satisfactory.

Figure 6:
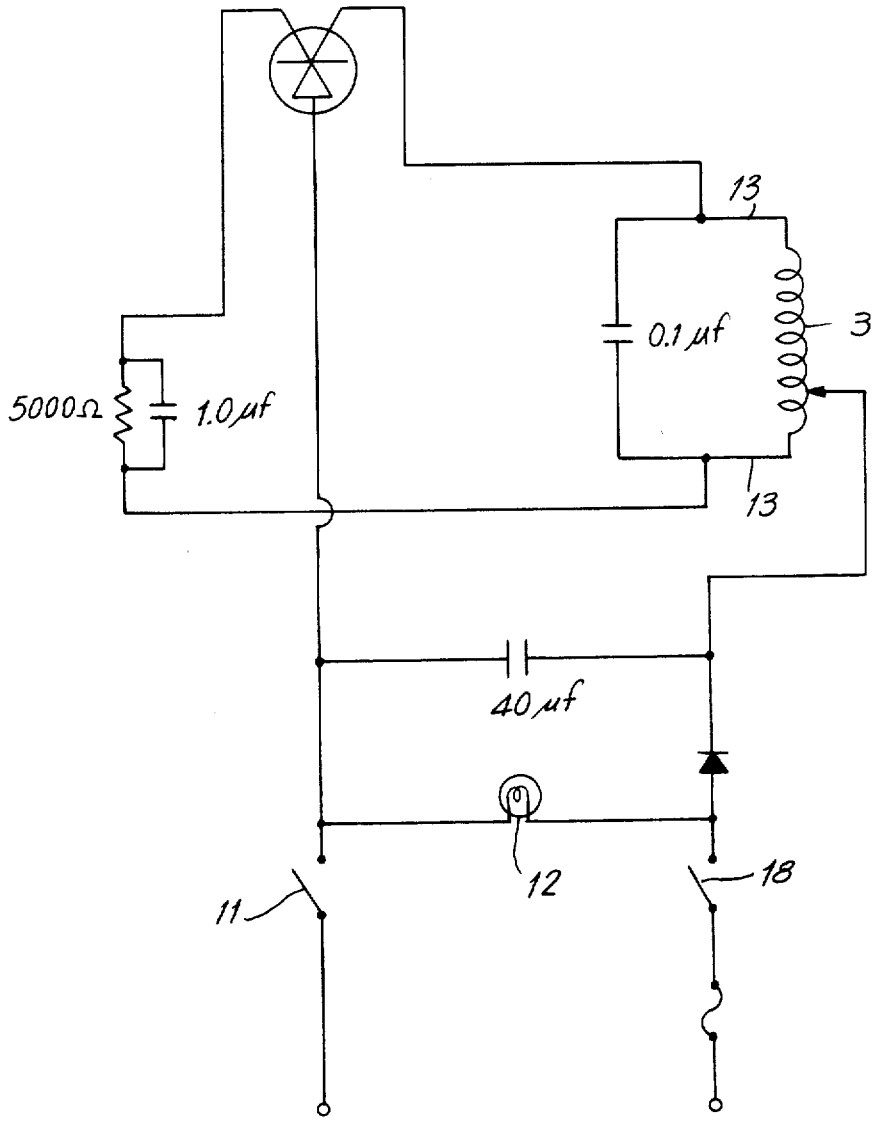
FIG. 6 is a schematic diagram of a typical circuit of an induction roller heater, useful in the present invention.

An acceptable power source to the coil is a resonant circuit as depicted in FIG. 6, energized by a 110 volt line. It is switched at the resonant frequency by a solid state device. The most satisfactory is a device designed for inverters and high speed switching. Triacs at present do not perform satisfactorily because they have a slow turn off time. Silicon controlled rectifiers (SCR), however, perform satisfactorily. The SCR is essentially a rectifier in the reverse direction and a rectifier switch in the forward direction. The current in the forward direction can be controlled by gating the electronic switch. The SCR has been used in various types of inverters in recent years, including induction heating power sources at much higher power levels than required for personal care appliances.

As illustrated in FIGS. 1, 2, 3, 4 and 5, in a preferred embodiment of this invention, a cylindrical hair roller 1 is inserted into cylindrical well 2 formed from a cylindrical well wall 7 closed at the bottom.

The well wall 7, made of a non-conductor of electricity, preferably plastic, has about forty turns of an insulated coil 3 wrapped around it, from top to bottom. The coil 3 of the well 2 is electrically connected by wires 13 to the oscillator circuit shown in FIG. 6 which is in turn connected to an electric power source, not shown.

The cylindrical hair roller 1 is a plastic body 14 closed at the top and open at the bottom. Inside the plastic body 14 of the hair roller 1 is a cylinder 4 made of a material of high permeability to electricity, preferably steel, which fits inside the roller 1. The steel cylinder 4 is open at both ends and has a low temperature Curie cup 5 attached at its bottom end so that when the hair roller 1 is inserted into the well 2, the Curie cup 5 rests on a plastic annular washer 6 on the inside of the hair roller 1.

Figure 4:
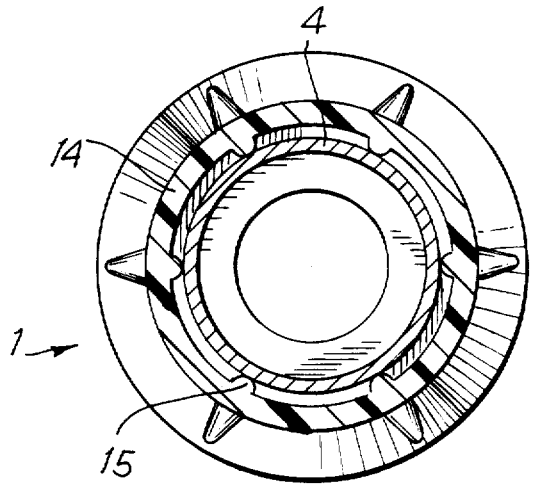
FIG. 4 is a top sectional view of a hair roller of this invention.
Figure 5:
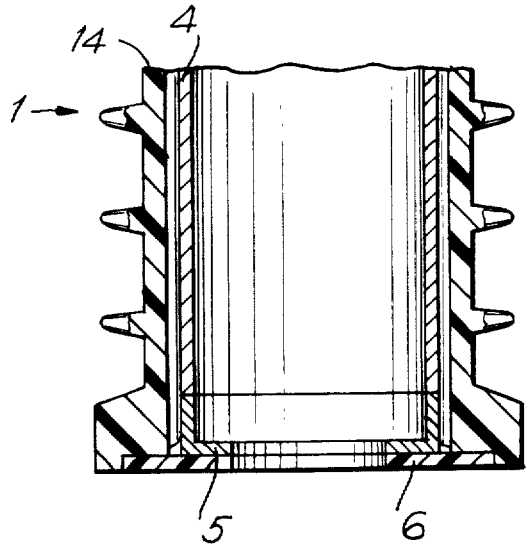
FIG. 5 is a side sectional view of the lower portion of a hair roller of this invention.

The inside of the plastic body 14, as shown in FIG. 4 can have axial ridges 15 which the outer surface of the cylinder 4 contacts to delay transfer of heat to the plastic body 14.

The bottom of the well 2 is in contact with a permanent magnet 8 which is attached to a lever 9 that has a pivot 10 about two-thirds of its length from the magnet 8. The short end of the lever 9 has a switch contact 11 which opens and closes the circuit 3. In the circuit is an indicator light 12 which indicates when the circuit is on, or can be wired to glow when the circuit is open to indicate completion of the heating cycle. Audible signals for this purpose can also be used.

In use, the preferred embodiment operates as follows: The on-off switch 18, shown in FIG. 6, is turned on. A hair roller 1 having a high permeability cylinder 4 therein is inserted into the well 2. The magnet 8 is attracted to the Curie cup 5 within the roller 1. This causes the lever 9 to pivot, closing the switch contact 11. The signal light 12 will glow when wired as shown in FIG. 6, or will go out, if wired across the switch contact 11. Closing of the switch contacts 11 will cause the oscillator to produce a high frequency current in the coil 3 which, by magnetic induction, and eddy current losses, heats the cylinder 4 and the Curie cup 5 within the roller 1. When the Curie cup 5 reaches its Curie temperature it loses its magnetic properties and the permanent magnet 8 drops off causing the lever 9 to pivot, opening the switch contact 11, with the result that the current stops flowing through the coil 3. The signal light 12 indicates completion of the heating cycle.

The user can, upon completion of the heating cycle, remove the roller 1 from the well 2 and place another roller 1 into the well 2. The heated roller 1 is then placed into the hair. As only the cylinder 4 was heated, the outside of the roller 1 is not hot and can be comfortably handled. After the roller 1 is placed in the hair the heat is conducted from the cylinder 4 to the inside of the plastic body 14 over the ridges (splines) 15 shown in FIG. 4. This introduces a time delay so that the outside surface of the roller body 14 reaches its final temperature only after the roller 1 is placed in the users hair.

The heating of the roller 1 in the well 2 takes 8–15 seconds which is the approximate time it takes to wind a roller into the hair.

I claim:

1. An apparatus for inductively heating hair curlers comprising in combination at least one hair curler and an associated inductive heating unit for receiving and heating same prior to engagement with a tress of hair, said hair curler further comprising:

an electrically non-conductive hollow outer member heatable by conduction;

a hollow core member within said outer member heatable by induction to a predetermined temperature;

means interposed between said core member and said outer member for conducting heat therebetween with a time delay between said core member reaching said predetermined temperature and said outer member reaching a final temperature, said delay being a predetermined duration to facilitate handling;

an alloy member having a predetermined Curie point, said alloy member being in thermal contact with said core member for being heated thereby, said alloy member being within said hair curler so as to be insulated from possible electrical contact with said inductive heating unit;

and said inductive heating unit further comprising:

coil means for substantially surrounding said curler during the inductive heating thereof;

circuit means for passing oscillating current through said coil means;

a movable magnetic switch member mounted so as to be in operative magnetic association with said alloy member when said curler is received by said inductive heating unit, said magnetic switch member and said alloy member being magnetically attracted while the temperature of said alloy member is under said Curie point;

switch means operatively connected to said magnetic switch member and to said circuit means for closing said circuit when said alloy member magnetically attracts said magnetic switch member and for opening same otherwise.

* * * * *